US005698947A

United States Patent [19]

Choi

[11] Patent Number: 5,698,947

[45] Date of Patent: Dec. 16, 1997

[54] HIGH PRESSURE SODIUM LAMP

[75] Inventor: Kyung-nam Choi, Kyungsangnam-do, Rep. of Korea

[73] Assignee: Samsung Display Devices Co., Ltd., Kyungki-do, Rep. of Korea

[21] Appl. No.: 680,823

[22] Filed: Jul. 16, 1996

[30] Foreign Application Priority Data

Oct. 30, 1995 [KR] Rep. of Korea ..... 95-38230

[51] Int. Cl.[6] ..... H01J 61/36

[52] U.S. Cl. ..... 313/623; 313/331; 313/25; 313/625; 313/638

[58] Field of Search ..... 313/25, 624, 625, 313/623, 626, 631, 332, 331, 570, 572, 638

[56] References Cited

U.S. PATENT DOCUMENTS 4,295,075 10/1981 Webb et al. ..... 313/624
4,479,071 10/1984 T'Jampens et al. ..... 313/626 X
4,708,679 11/1987 Dunn et al. ..... 313/25 X
4,774,431 9/1988 Dunn et al. ..... 313/623 X
5,343,117 8/1994 Wyner et al. ..... 313/625 X
5,424,608 6/1995 Juengst et al. ..... 313/625 X

*Primary Examiner*—Ashok Patel
*Attorney, Agent, or Firm*—Leydig, Voit & Mayer, Ltd.

[57] ABSTRACT

A high pressure sodium lamp is provided. The high pressure sodium lamp includes a discharge lamp vessel to the ends of which a pair of electrodes are respectively connected, a sleeve coupled to at least one end of the discharge lamp vessel and connected to one of the electrodes, a wire frame slidably inserted into the sleeve, and a buffer coil, one end of which is connected with the wire frame and the other end of which is housed inside the sleeve, elastically supporting the discharge lamp vessel.

3 Claims, 2 Drawing Sheets

HIGH PRESSURE SODIUM LAMP

BACKGROUND OF THE INVENTION

The present invention relates to a high-pressure sodium lamp and, more particularly, to a high-pressure sodium lamp with a structure improved to compensate for the change in length of a discharge lamp vessel caused by thermal expansion.

High-pressure sodium lamps have been widely used for both indoor and outdoor illumination due to their high efficiency and relative brightness.

A conventional high-pressure sodium lamp is shown in FIG. 1. As shown in FIG. 1, there is an outer envelope 5 defining the general appearance of the lamp, which is filled with a gas such as nitrogen. A discharge lamp vessel 1, usually composed of translucent polycrystalline alumina, whose main chemical component is aluminum oxide ($Al_2O_3$), is placed at the center of the outer envelope 5 and emits light when electrical power is applied thereto. A pair of electrodes 1*a* and 1*b* are connected to the ends of the discharge lamp vessel 1, respectively. Lead wires 2 and 3 emerging from a stem 4 are connected to the electrodes 1*a* and 1*b*, respectively. Here, the lead wires 2 and 3 have a further function of supporting the discharge lamp vessel 1.

In the high-pressure sodium lamp constructed as above, when electrical power is supplied to the discharge lamp vessel 1 via the lead wires 2 and 3 to establish a potential difference across the discharge lamp vessel 1, compounds in the discharge lamp vessel 1 are ionized, thus emitting light.

However, when the sodium lamp is energized, the temperature of the discharge lamp vessel 1 is increased to about 700°~800° C., so that the discharge lamp vessel 1 is influenced by a high temperature and gradually expands. When the lamp is de-energized, the discharge lamp vessel 1 gradually cools and contracts to its original size. Here, such expansion-contraction cycling of the discharge lamp vessel 1 gives rise to fatigue of the lamp's electrical connections, i.e., between the lead wires 2 and 3 and the electrodes 1*a* and 1*b*, or the discharge lamp vessel 1 and the electrodes 1*a* and 1*b*, which leads to the fracture of these connections. Also, this thermal fatigue of the connections directly contributes to the shortening of the lamp's life span.

Therefore, to reduce thermal fatigue, the conventional high-pressure sodium lamp has a tube 6 made of niobium (Nb) attached to at least one of the electrodes 1*a* and 1*b* and the corresponding lead wire(s) 2 (and/or 3) is coupled to the niobium tube 6 through a welding process. Here, the effect of the thermal expansion of the discharge lamp vessel 1 is transferred to the lead wires 2 and 3 via the niobium tube 6 and is thereby reduced.

However, the structure of the conventional high-pressure sodium lamp as described above is insufficient in that complete elimination of the thermal fatigue of the electrical connections is not achieved. Furthermore, it is difficult to weld the niobium tube 6 to the lead wires 2 and 3, thereby lowering productivity and increasing manufacturing costs.

SUMMARY OF THE INVENTION

It is an object of the present invention to provide a high-pressure sodium lamp that effectively eliminates thermal fatigue of electrical connections caused by thermal expansion and contraction of a discharge lamp vessel.

To achieve the above object, there is provided a high-pressure sodium lamp comprising: a discharge lamp vessel to the ends of which a pair of electrodes are respectively connected; a sleeve coupled to at least one end of the discharge lamp vessel to be connected to one of the electrodes; a wire frame slidably inserted into the sleeve; and a buffer coil one end of which is connected with the wire frame and the other end of which is housed inside the sleeve, for elastically supporting the discharge lamp vessel.

Preferably, the sleeve is made of niobium and the discharge lamp vessel is made of translucent polycrystalline alumina.

In the high-pressure sodium lamp according to the present invention, the change in length of the, discharge lamp vessel, caused by thermal expansion and contraction can be relieved by a buffer coil.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
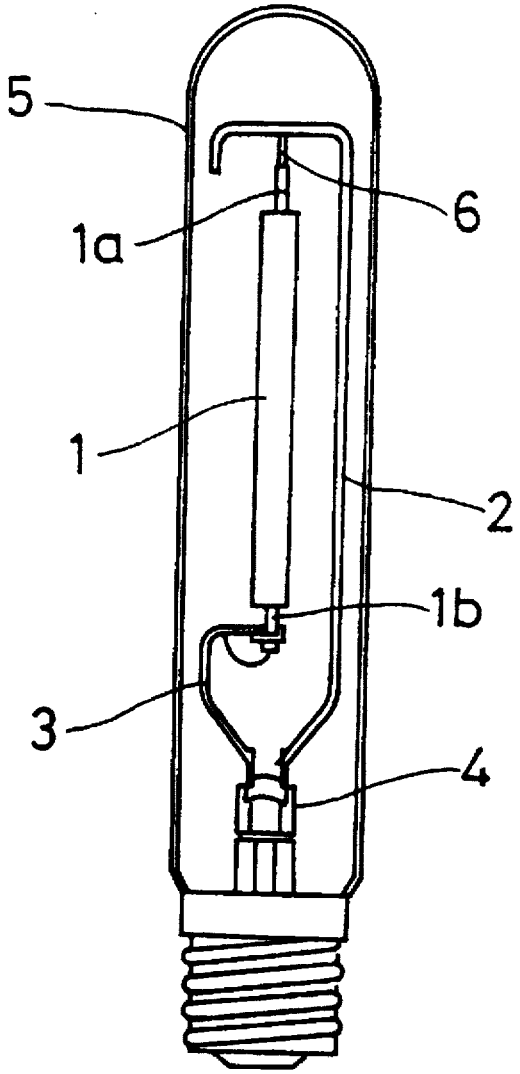
FIG. 1 (PRIOR ART)
FIG. 1 is a schematic diagram of a conventional high-pressure sodium lamp.
Figure 3:
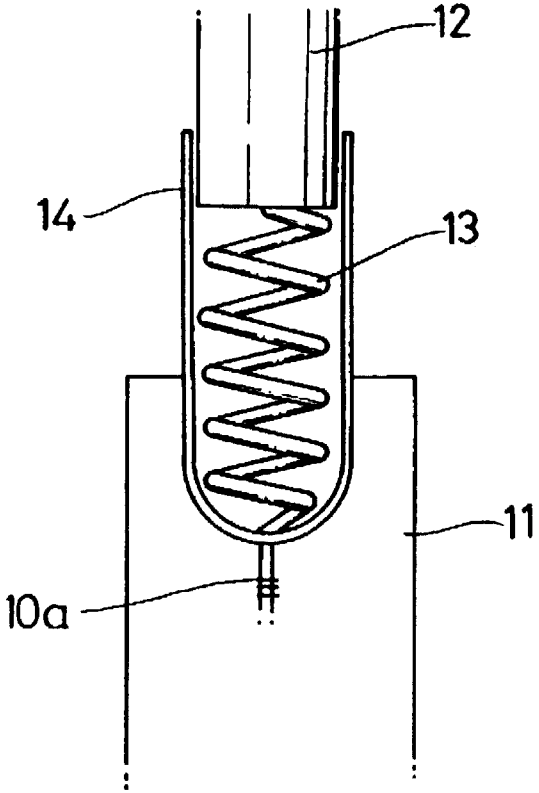
FIG. 3 is a detailed diagram of the part "A" shown in FIG. 2.
Figure 2:
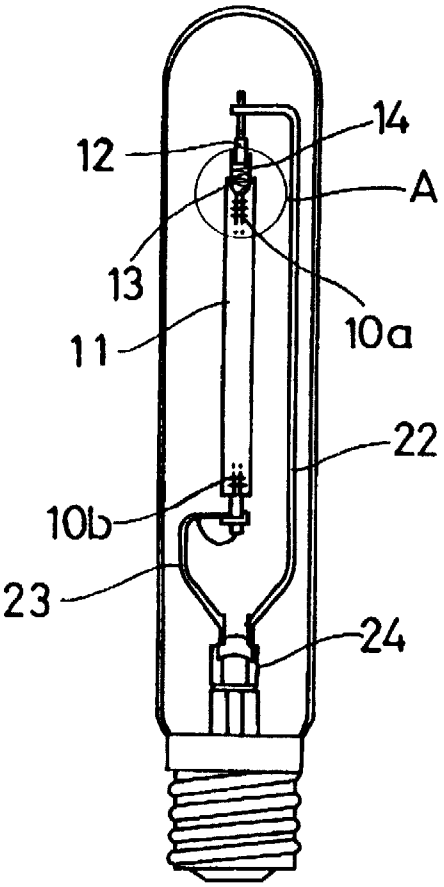
FIG. 2 is a schematic diagram of a high-pressure sodium lamp according to the present invention.

Referring to FIGS. 2 and 3, a pair of electrodes 10*a* and 10*b* are provided at the ends of a discharge lamp vessel 11 of a high-pressure sodium lamp according to the present invention. A cup-shaped sleeve 14 is coupled to at least one end of the discharge lamp vessel 11. The electrode 10*a* is connected to one end of the sleeve 14, and a wire frame 12 is slidably inserted into the other end in a manner which allows the free movement of the wire frame 12 within the sleeve 14 and electrical connection of the wire frame 12 to the electrode 10*a*. Also, one end of the wire frame 12 is connected with a buffer coil 13 and the other end of the wire frame 12 is connected to a lead wire 22. The buffer coil 13 is housed inside the sleeve 14, and elastically supports the discharge lamp vessel 11 allowing it to expand.

The above structure can be obtained by welding the buffer coil 13 to the wire frame 12 and inserting the obtained assembly into the sleeve 14 against the elastic force of the buffer coil 13.

It is preferable that the sleeve 14 be conductive and composed of niobium and that the buffer coil 13 be made of a metal which is able to withstand high temperature and high current. Also, it is preferable that the elastic coefficient of the buffer coil 13 be such that even a small thermal expansion of the discharge lamp vessel 11 can be relieved.

To further improve upon the design, an assembly comprised of the wire frame 12, buffer coil 13 and sleeve 14 may be installed at both ends of the discharge lamp vessel 11. In doing so, the expansion of the discharge lamp vessel 11 can be more evenly absorbed.

In the operation of the high-pressure sodium lamp according to the present invention, current passing through the lead wire 22 is applied to the electrode 10*a* via the wire frame 12 and the buffer coil 13. In case the sleeve 14 is conductive, current may be transferred to the electrode 10*a* via the sleeve 14. Subsequently, when the discharge lamp vessel 11 which is supported by the lead wires 22 and 23 extending from a stem 24 gradually expands while energized, the buffer coil 13 is compressed by the expansion force of the discharge lamp vessel 11. On the contrary, when de-energized, the discharge lamp vessel 11 contracts gradually by cooling, until reaching its original size. As a result, the buffer coil 13 undergoes a corresponding relaxation. These compressions and extensions of the buffer coil 13 prevent fatigue-induced fracture of the welded portions of the lead wires, thereby lengthening the life span of the lamp.

In a high-pressure sodium lamp according to the present invention, the discharge lamp vessel can be elastically supported to allow expansion, not by directly welding the wire frame thereto but by simply inserting the wire frame with the buffer coil affixed thereto into the sleeve.

While the present invention has been illustrated and described with reference to a specific embodiment and appended drawings, further modifications and alterations are possible within the spirit and scope of the invention as defined by the appended claims.

What is claimed is:

1. A high pressure sodium lamp comprising:

a discharge lamp vessel having ends to which respective electrodes are connected;

an electrically conductive hollow sleeve having an inside diameter, coupled to an end of said discharge lamp vessel, and connected to one of said electrodes;

a wire for supporting said discharge lamp vessel, having an outside diameter substantially equal to the inside diameter of said sleeve, and slidably disposed within said sleeve; and a buffer coil having a first end connected to said wire and a second end contacting said sleeve, said buffer coil being housed inside said sleeve, electrically connecting said electrode to said wire through said sleeve and elastically supporting said discharge lamp vessel whereby changes in length of said discharge lamp vessel are compensated for by relative movement of said wire and said sleeve and extension and compression of said buffer coil.

2. The high pressure sodium lamp as claimed in claim 1, wherein said sleeve is niobium.

3. The high pressure sodium lamp as claimed in claim 1, wherein said discharge lamp vessel is translucent polycrystalline alumina.

* * * * *